US005316344A

United States Patent [19]

Popat et al.

[11] Patent Number: 5,316,344

[45] Date of Patent: May 31, 1994

[54] STATIONERY WITH REMOVABLE PRINTABLE LABELS AND METHOD THEREFOR

[75] Inventors: Ghanshyam H. Popat, Alta Loma; Stephen M. Sharp, Glendora, both of Calif.

[73] Assignee: Avery Dennison Corporation, Pasadena, Calif.

[21] Appl. No.: 922,818

[22] Filed: Jul. 31, 1992

[51] Int. Cl.[5] ..... B42D 15/00

[52] U.S. Cl. ..... 283/81; 283/67; 283/116

[58] Field of Search ..... 283/67, 75, 81, 101, 283/56, 116; 229/68; 281/2, 5; 428/40–43

[56] References Cited

U.S. PATENT DOCUMENTS 2,109,583 3/1938 Bennett .
3,107,195 10/1963 Stegler et al. .
3,822,492 7/1974 Crawley .
3,925,584 12/1975 Suzuki et al. .
4,029,341 6/1977 Neill et al. .
4,379,573 4/1983 Lomeli et al. .
4,664,416 5/1987 Steidinger .
4,771,891 9/1988 Sorensen et al. .
4,938,414 7/1990 Lippert .
4,993,752 2/1991 Juszak ..... 283/67
5,007,663 4/1991 Moran ..... 283/81

*Primary Examiner*—Timothy V. Eley
*Assistant Examiner*—William Fridie, Jr.
*Attorney, Agent, or Firm*—Poms, Smith, Lande & Rose

[57] ABSTRACT

A stationery sheet having labels removably attached thereto by pressure-sensitive adhesive. The sheet may be sent through a laser printer or other printing equipment for the purpose of printing indicia on the sheet and the label. After the sheet exits the printer, the labels may be peeled off the sheet and attached to a letter or some other document. A release coating may be applied to the sheet at the areas where the labels are attached to facilitate peeling the labels from the sheet. A high temperature, stable, pressure-sensitive adhesive is used to facilitate passing the sheet through high temperature printers.

15 Claims, 1 Drawing Sheet

STATIONERY WITH REMOVABLE PRINTABLE LABELS AND METHOD THEREFOR

CROSS REFERENCE TO RELATED APPLICATIONS

The subject matter of this application is related to the subject matter of copending application, Ser. No. 07/668,991, filed Mar. 12, 1991, entitled "INDEX TAB LABEL ASSEMBLY," and is related to copending application, Ser. No. 07/874,067, filed Apr. 24, 1992, entitled "METHOD OF MAKING AN INDEX TAB LABEL ASSEMBLY," both of these copending applications being assigned to Avery Dennison Corporation, the assignee of the present application.

BACKGROUND OF THE INVENTION

The present application relates generally to stationery and labels, and more particularly to stationery using printable labels.

In the past, office personnel first print stationery, such as a letter, and then print forwarding and return addresses on an envelope. This requires two printing steps. Typically, a letter is prepared by sending a sheet of paper through printing equipment, such as laser printing equipment. Labels with forwarding and return addresses are then printed for an envelope using a typewriter or printing equipment, or addresses are directly printed on the envelope using a typewriter. This requires considerable time by office personnel when a large amount of stationery is prepared.

Typical labels are disclosed in U.S. Pat. Nos. 5,007,663, issued to Moran on Apr. 16, 1991, 4,993,752, issued to Juszak on Feb. 19, 1991; 4,938,414, issued to Lippert on Jul 3, 1990; 4,771,891, issued to Sorensen, et al. on Sep. 20, 1988; 4,664,416, issued to Steidinger on May 12, 1987; 4,379,573, issued to Lomeli, et al. on Apr. 12, 1983; 4,029,341, issued to Neill, et al. on Jun. 14, 1977; and 3,822,492, issued to Crawley, on Jul. 9, 1974. Adhesives are disclosed in U.S. Pat. Nos. 3,925,584, issued to Suzuki, et al. on Dec. 9, 1975; 3,107,195, issued to Stegler, et al. on Oct. 15, 1963; and 2,109,583, issued to Bennett on Mar. 1, 1938.

SUMMARY OF THE INVENTION

It is an object of this invention to provide stationery with removable printable labels which may be used with laser or other printing equipment.

It is another object of this invention to provide stationery with removable printable labels which may have indicia printed thereon by passing the stationery through laser or other printing equipment in a single printing step.

It is still another object of this invention to provide stationery with removable printable labels which is easy to use and economical to manufacture.

These and other objects and advantages are attained by a stationery sheet having labels removably attached thereto by pressure-sensitive adhesive. The sheet may be sent through a laser printer or other printing equipment for the purpose of printing indicia on the sheet and the label. After the sheet exits the printer, the labels may be peeled off the sheet and attached to a letter or some other document. A release coating may be applied to the sheet at the areas where the labels are attached to facilitate peeling the labels from the sheet. A high temperature, stable, pressure-sensitive adhesive is used to facilitate passing the sheet through high temperature printers without contamination of the printers.

In accordance with one aspect of the invention, the stationery sheets may be substantially rougher in smoothness qualities than the envelopes so that the labels will adhere firmly to the envelopes but may be peeled off the stationery sheets.

In accordance with a further feature of the invention, it is preferable that the thickness of the stationery assembly including the stationery sheet and the label be limited to the thickness of these two elements, the sheet and the label, with the adhesive associated with the label.

The various features of the present invention will be best understood together with further objects and advantages by reference to the following description of the preferred embodiment taken in conjunction with the accompanying drawings.

DESCRIPTION OF THE PREFERRED EMBODIMENT

The following specification taken in conjunction with the drawings sets forth the preferred embodiment of the present invention in such a manner that any person skilled in the art can make and use the invention. The embodiment of the invention disclosed herein is the best mode contemplated by the inventors for carrying out their invention in a commercial environment although it should be understood that various modifications can be accomplished within the parameters of the present invention.

Figure 1:
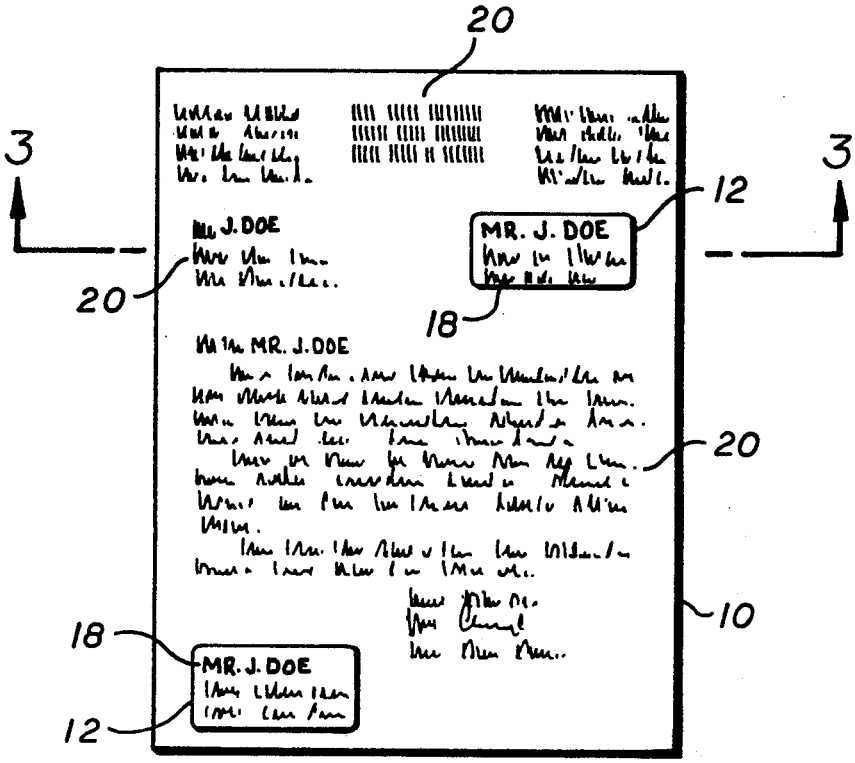
FIG. 1 is a front elevational view of a stationery sheet with printable removable labels illustrating the principles of the present invention.
Figure 3:
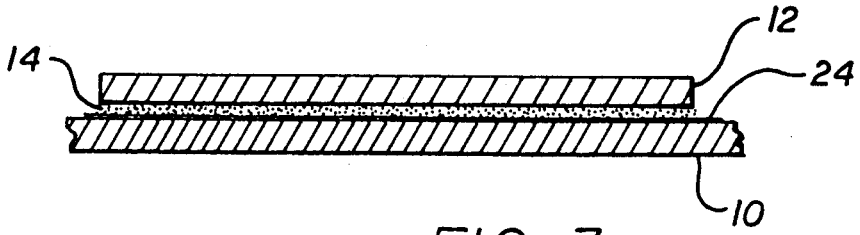
FIG. 3 is a cross-sectional view taken in the direction of arrows 3—3 shown in FIG. 1.

FIG. 1 shows a stationery sheet 10 having labels 12 applied thereto illustrating the present invention. As illustrated in FIG. 3, the labels 12 are removably attached to the sheet 10 by a stable, pressure-sensitive adhesive 14 of a type which will not flow at a temperature of a few hundred degrees Fahrenheit. However, it is preferred that the pressure-sensitive adhesive 14 will remain stable when subjected to temperatures in the range of up to about 300 to about 400 degrees Fahrenheit to facilitate printing by passing the sheet 10 and labels 12 through laser or other high temperature printing equipment, as discussed below.

The adhesive 14 may be any suitable, stable, pressure-sensitive adhesive which facilitates printing at high temperatures, peeling from the sheet 10, and adhering the labels 12 to an envelope 16, as discussed below.

The stationery sheet 10 is preferably a sheet of paper such as used for letters. Likewise, the envelope 16 is preferably made from paper. However, the sheet 10 and envelope 16 may be made out of any desirable material such as plastic, etc.

Figure 2:
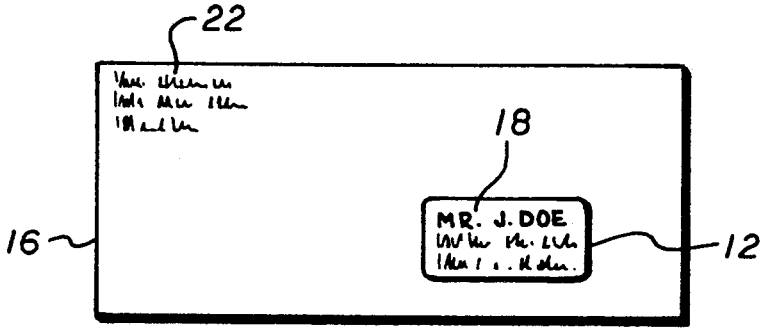
FIG. 2 is a front elevational view of a stationery envelope having one of the labels applied thereto.

Any number of labels 12 may be removably attached to the sheet 10 by the adhesive 14. The sheet 10 may be sent through laser or other printing equipment in order to print indicia 18 and 20 on the labels 12 and sheet 10, respectively. Sheet 10 may, for example, be a letter and indicia 20 would represent the printing on the letter. Indicia 18 on the labels 12 may, for example, represent the forwarding and return addresses for the envelope 16. Note that only one label 12 with a forwarding address 18 is shown in FIG. 2. However, another label 12 with a return address 18 may be used instead of the printing 22 on the envelope 16 shown in FIG. 2.

Sheet 10 may represent any other document such as a business form, advertisement, or the like, with printing 20 thereon, and any number of labels 12 with any type of printing 18 may be used on such a document.

The labels 12 may be made out of any desirable material such as paper, polyester film, or the like, and may have a coating thereon to facilitate printing thereon, if desired. It is intended that any material may be used for the sheet 10 or labels 12 that allows indicia to be printed thereon.

Preferably, the surface of the envelope 16 is smoother than the surface of the stationery sheet 10. As such, the labels 12 will adhere more firmly to the envelope than to the stationery sheet 10. Alternatively, a silicone release coating 24 (see FIG. 3) may be applied to the sheet 10 at the areas where the labels 12 are applied to the sheet 10. Any other type of release coating 24 may be used. For example, a fluorinated or amino-based release coating 24 may be used.

Preferably, the Sheffield smoothness values of the stationery sheet 10 and envelope 16 are about 280 and about 145, respectively. Also preferably, the difference between the Sheffield values of the sheet 10 and envelope 16 ranges from about 50 to about 400. The sheffield values may be measured, for example, by a Hagerty Technologies Model 538 paper smoothness tester.

The nature of an adhesive, whether permanent or removable, is often specified by a peel force, or by the force required to peel a one-inch wide sample strip at right angles from a stainless steel surface to which it has been adhered. Standards and procedures for measuring peel forces have been established by the Pressure Sensitive Tape Council, and the peel forces as used herein relate to tests made pursuant to such standard procedures. The designation "permanent adhesives" is normally applied to adhesives having peel forces in the order of 3 pounds or more, while adhesives having a peel force of less than about 2 pounds are normally referred to as removable adhesive coatings.

The adhesive 14 and Sheffield values of the stationery sheet 10 and envelope 16 are chosen so that the force required to peel the labels 12 from the stationery sheet 10 or envelope 16 facilitates keeping the labels 10 secured to the sheet 10 when the sheet 10 is passed through printing equipment, but allows the labels 12 to be easily peeled from the sheet 10 after printing, and then securely attached to the envelope 16.

Preferably, adhesive 14 is Avery Dennison Adhesive AS3664 which is a suspension of microspheres of adhesive in a heptane solvent. However, any suitable solvent based removable adhesive may be used. For example, heptane solvent may be used in combination with other solvents, or other solvents may be used without heptane solvent.

The above-described adhesive 14, preferably, has a peel force in a range of from about 100 grams to about 500 grams when peeling a one-inch wide strip from a stainless steel surface at a speed of 300 inches/minute, and a peel force in the range of from about 20 grams to about 100 grams when peeling a one-inch wide strip from the sheet 10 or envelope 16 at a speed of 300 inches/minute.

It is further noted that label stock coated with Moore's CleanTac TM could be employed for the labels employed herein.

It is important to note that any suitable adhesive 14 may be used for the present invention, and the adhesive 14 may have any desired composition.

In use, the stationery sheet 10, with labels 12 removably attached thereto is sent through a laser printer or other printing equipment. After sheet 10 exits the printer, the labels 12 are peeled from the sheet 10 and applied to the envelope 16. However, labels 12 may be applied to other documents or papers, if desired, and may be used for any other purpose such as being placed on a file folder, container, etc.

The above description discloses the preferred embodiment of the present invention. However, persons of ordinary skill in the art are capable of numerous modifications once taught these principles. For instance, by way of example and not limitation, sheet 10 may be sent through electrostatic (Xerographic) copiers. The labels 12 may be transparent, opaque, or of different colors. Accordingly, it will be understood by those skilled in the art that changes in form and details may be made to the above-described embodiment without departing from the spirit and scope of the invention.

We claim:

1. Stationery for use with an envelope having a selected Sheffield smoothness value comprising:

a sheet having a selected Sheffield smoothness value, said Sheffield smoothness values being different so that said Sheffield smoothness value of said sheet is higher than said Sheffield smoothness value of said envelope;

a single label having an adhesive applied to one side thereof, said adhesive removably attaching said label directly to said sheet, said sheet adapted to be sent through a printer in order to print indicia on said sheet and said label, said difference in Sheffield smoothness values being selected to facilitate peeling said label off said sheet after exit from said printer and then using said adhesive to firmly secure said label to said envelope; and the surface of said envelope being smoother than the surface of said stationery sheet, with the difference in the Sheffield smoothness values between said envelope and said sheet being equal to or greater than 50.

2. The stationery of claim 1 wherein said difference in Sheffield smoothness values has a range of from about 50 to about 400.

3. The stationery of claim 1 wherein said adhesive is a stable, pressure-sensitive adhesive.

4. The stationary of claim 3 wherein said stable, pressure-sensitive adhesive is not activated by a temperature of up to about 400° Fahrenheit.

5. The stationery of claim 3 wherein said adhesive is a solvent based adhesive having a peel force with a range of from about 20 grams to about 100 grams when peeling said label from said sheet and said envelope.

6. A method of producing stationery comprising the steps of:

forming a sheet having a selected Sheffield smoothness value;

removably applying a single label to said sheet;

printing indicia on said label and said sheet by sending said sheet through a printer;

removing said label from said sheet;

applying said label to another item having a different Sheffield smoothness value and being smoother than said sheet, said difference in Sheffield smoothness values facilitating removing said label from said sheet and applying said label to said another item; and said method including forming the interface between the label and the stationery sheet with the interface consisting solely of (1) the label, (2) pressure sensitive adhesive and (3) the stationery sheet.

7. The method of claim 6 wherein said difference in Sheffield smoothness values has a range of from about 50 to about 400.

8. The method of claim 6 wherein said label has a pressure-sensitive adhesive applied to one side thereof.

9. The method of claim 6 wherein said sheet forming step includes applying a release coating to said sheet.

10. The method of claim 8 wherein said pressure-sensitive adhesive is not activated by a temperature of up to about 400° Fahrenheit.

11. The method of claim 6 wherein said another item is an envelope.

12. The method of claim 6 wherein said another item is a file folder. said label from said sheet and applying said label to said another item; and said method including forming the interface between the label and the stationery sheet with the interface consisting solely (1) the label, (2) pressure sensitive adhesive and (3) the stationery sheet.

13. A stationery assembly comprising:

a stationery sheet;

a single label having a pressure-sensitive adhesive applied to one side thereof, said adhesive removably attaching said label directly to said sheet in an area which is normally not used for printed messages, said sheet being adapted to be sent through a printer in order to print indicia on said sheet and said label;

said pressure sensitive adhesive being stable and resistant to flow up to a temperature above the operating temperature of laser printers;

the thickness of the self-container subassembly including said stationery sheet and said label being limited only to two layers of said stationery sheet and said label with its associated pressure sensitive adhesive;

an envelope for receiving said label;

said assembly including means for permitting said label to be peeled off of said stationery sheet but holding said label securely to said envelope, the interface between the label and the stationery sheet consisting solely of (1) the label, (2) pressure sensitive adhesive and (3) the stationery sheet; and the surface of said envelope being smoother than the surface of said stationery sheet, with the difference in the Sheffield smoothness values between said envelope and said sheet being equal to or greater than 50.

14. A stationery assembly comprising:

a stationery sheet;

a single label having a pressure-sensitive adhesive applied to one side thereof, said adhesive removably attaching said label directly to said sheet in an area which is normally not used for printed messages, said sheet adapted to be sent through a printer in order to print indicia on said sheet and said label;

said pressure sensitive adhesive being stable and resistant to flow up to a temperature above the operating temperature of laser printers;

the thickness of the assembly including said stationery sheet and said label being limited only to two layers of said stationery sheet and said label with its associated pressure sensitive adhesive;

another stationery item for receiving said label;

said assembly including means for permitting said label to be peeled off of said stationery sheet but holding said label securely to said other stationery item, the interface between the label and the stationery sheet consisting solely of (1) the label, (2) pressure sensitive adhesive and (3) the stationery sheet; and the surface of said other stationery item being smoother than the surface of said stationery sheet.

15. A stationery assembly as defined in claim 14, wherein said other stationery item is an envelope.

* * * * *

US005316344B1

(12) REEXAMINATION CERTIFICATE (4513th)

United States Patent

Popat et al.

(10) Number: US 5,316,344 C1

(45) Certificate Issued: Jan. 8, 2002

(54) STATIONERY WITH REMOVABLE PRINTABLE LABELS AND METHOD THEREFOR

(75) Inventors: Ghanshyam H. Popat, Alta Loma; Stephen M. Sharp, Glendora, both of CA (US)

(73) Assignee: Avery Dennison Corporation, Pasadena, CA (US)

Reexamination Request:
No. 90/005,545, Nov. 4, 1999

Reexamination Certificate for:

| | |
|---|---|
| Patent No.: | **5,316,344** |
| Issued: | **May 31, 1994** |
| Appl. No.: | **07/922,818** |
| Filed: | **Jul. 31, 1992** |

(51) Int. Cl.[7] ..... B42D 15/00

(52) U.S. Cl. ..... 283/81; 283/67; 283/116

(58) Field of Search ..... 283/67, 70, 75, 283/79, 80, 81, 56, 101; 229/68.1

(56) References Cited

U.S. PATENT DOCUMENTS

| | | | | |
|---|---|---|---|---|
| 4,784,317 A | * | 11/1988 | Chen et al. | 229/92.3 |
| 4,898,323 A | * | 2/1990 | Chen et al. | 229/92.3 |
| 4,915,288 A | * | 4/1990 | Kao et al. | 229/80 |
| 4,938,414 A | | 7/1990 | Lippert | 229/92.8 |
| 5,007,663 A | | 4/1991 | Moran | 283/81 |
| 5,098,759 A | | 3/1992 | Felix | 428/42 |

* cited by examiner

*Primary Examiner*—William Fridie

(57) ABSTRACT

A stationery sheet having labels removably attached thereto by pressure-sensitive adhesive. The sheet may be sent through a laser printer or other printing equipment for the purpose of printing indicia on the steel and the label. After the sheet exits the printer, the labels may be peeled off the sheet and attached to a letter or some other document. A release coating may be applied to the sheet at the areas where the labels are attached to facilitate peeling the labels from the sheet. A high temperature, stable, pressure-sensitive adhesive is used to facilitate passing the sheet through high temperature printers.

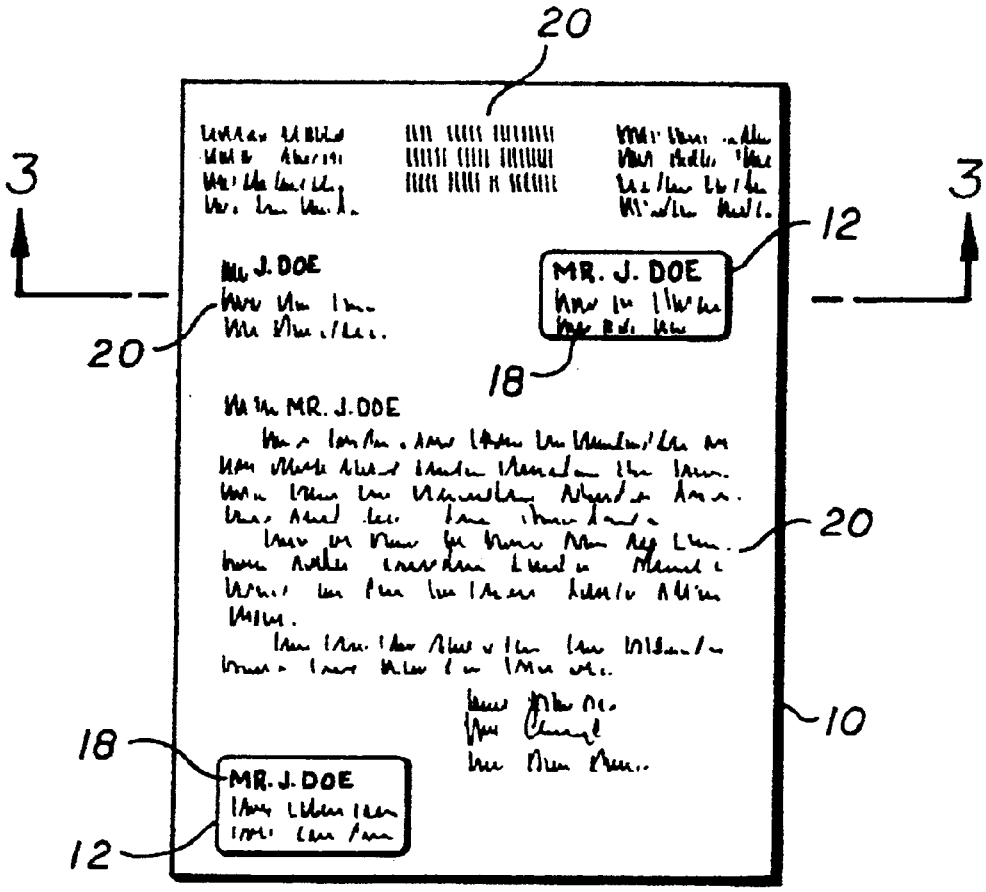

REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

The patentability of claims 1–13 is confirmed.

Claims 14 and 15 are cancelled.

* * * * *